US005724896A

United States Patent [19]

Koenig

[11] Patent Number: 5,724,896

[45] Date of Patent: Mar. 10, 1998

[54] METHOD AND APPARATUS FOR PROVIDING SUPPLEMENTAL FUEL TO A ROTARY KILN

[76] Inventor: Larry E. Koenig, c/o Komar Industries, Inc. 4425 Marketing Pl., Groveport, Ohio 43125

[21] Appl. No.: 619,037

[22] Filed: Mar. 20, 1996

[51] Int. Cl.[6] ..... F27B 7/20

[52] U.S. Cl. ..... 110/246; 110/109; 432/103

[58] Field of Search ..... 432/103, 105, 432/109; 110/109, 226, 246, 264, 289, 346

[56] References Cited

U.S. PATENT DOCUMENTS

| | | | |
|---|---|---|---|
| 4,733,619 | 3/1988 | Maeda et al. | 110/229 |
| 4,930,965 | 6/1990 | Peterson et al. | 432/105 |
| 4,984,983 | 1/1991 | Enkegaard | 432/14 |
| 5,078,594 | 1/1992 | Tutt et al. | 432/103 |
| 5,083,516 | 1/1992 | Benoit et al. | 110/344 |
| 5,086,716 | 2/1992 | Lafser, Jr. | 110/345 |
| 5,193,490 | 3/1993 | Peruski | 122/4 |
| 5,257,586 | 11/1993 | Davenport | 432/109 |
| 5,341,962 | 8/1994 | Way et al. | 222/248 |
| 5,377,603 | 1/1995 | Reese et al. | 110/346 |
| 5,549,058 | 8/1996 | Tutt | 432/103 |

*Primary Examiner*—Henry A. Bennett
*Assistant Examiner*—Gregory Wilson
*Attorney, Agent, or Firm*—Thompson Hine & Flory LLP

[57] ABSTRACT

A method and apparatus for feeding a cement kiln through the kiln wall includes a processing component which shreds and blends supplemental fuel and conveys the fuel to a feeding station. The feeding station includes a feeding device, such as a ram or screw, which is moved on a carriage along rails so that the device remains in alignment with a port in the cement kiln through a period of rotation of the cement kiln sufficient to allow the fuel to be injected from the feeding device into the interior of the kiln.

27 Claims, 10 Drawing Sheets

METHOD AND APPARATUS FOR PROVIDING SUPPLEMENTAL FUEL TO A ROTARY KILN

BACKGROUND

The present invention relates to devices for providing supplemental fuel to rotary reactors and, more particularly, to systems for providing supplemental fuel to rotary cement kilns.

The manufacture of cement typically is conducted in a rotary kiln, which typically is relatively long—on the order of 100 to 300 feet—and has a diameter from 10 feet to 25 feet, or greater. The kiln is inclined downwardly along its length and the raw feed, which consists of calcium, silicates and some metals, is conveyed at the front, elevated end. The kiln is rotated slowly, on the order of one to two revolutions per minute, and the raw feed progresses along the length of the kiln. Heat is added in the downstream end of the kiln to a temperature of approximately 2000° C., and an exothermic reaction is started, in a downstream area known as a calcining zone. The finished product, known as klinker, exits the downstream end of the kiln, and is further processed by pulverizing it in a ball mill or the like to a flour-like consistency.

Accordingly, aside from the raw material cost, the predominate cost factor in the production of cement is the fuel cost. Accordingly, a number of attempts have been made to provide auxiliary or so-called supplemental fuels which provide heating value, and in some cases some metallics and other constituents of the cement. Attractive supplemental fuels include municipal solid waste, hazardous waste, and the like, which are attractive from a cost standpoint since, in many instances, the cement kiln operator is paid to dispose of such waste. Another desirable aspect of use of waste material as supplemental fuel is that, due to the high temperatures in the calcining zone of the kiln, complex and toxic carbon compounds are broken down substantially into more benign compounds, such as carbon dioxide and water vapor.

In order to maximize the heating value provided by supplemental fuels, and also to maximize the burning of such fuels in a high temperature environment, it is desirable to place such fuels in the calcining zone of the kiln. Previous attempts have been made which involve such things as ballistically projecting containerized fuel along the length of the cement kiln to the calcining zone, and directly injecting supplemental fuel through the wall of the kiln at the calcining zone. Of these two methods, it is preferable to inject supplemental fuel directly through the kiln wall into the calcining zone.

However, a disadvantage with such supplemental fuel injection is that the injection of fuel is made through a port in a cylindrical, rotating wall. In the past, this has necessitated the use of containerized fuel which is attractive from the standpoint of its being injected rapidly in a large volume. However, a disadvantage of the use of containerized fuel is that it creates a "hot zone" in the calcining zone which it ignites, which has tendency to upset the delegate chemical reactions occurring in the calcining zone, and further, the compaction inherent in a containerized fuel prevents a complete combustion of the fuel, and therefore has a tendency to generate undesirable emissions. Accordingly, there is a need for a method and apparatus of injecting supplemental fuel into a cement kiln which eliminates the need for containerization, and yet is capable of providing a rapid and efficient injection of fuel through a rotating kiln wall.

SUMMARY OF THE INVENTION

The present invention is a method and apparatus for injecting supplemental fuel into a rotary kiln directly through the kiln wall.

In a preferred embodiment of the invention, the apparatus includes a feeder for receiving supplemental fuel and injecting the fuel into an interior of a rotary kiln, and a feeder support which moves the feeder synchronously with rotation of the kiln so that the feeder remains in alignment with a side opening in the kiln for a period of time sufficient to allow the feeder to inject preprocessed fuel through the opening. Preferably, the feeder includes a housing and a rotary screw which receives preprocessed supplemental fuel and, when the housing in alignment with the kiln opening, the screw is actuated to inject the fuel into the kiln. In alternate embodiment, the housing includes a double acting ram which receives a charge of supplemental fuel, then is actuated to displace the fuel along the housing and into the kiln. With such an embodiment, it is desirable that the travel distance of the ram exceed the length of the housing so that the ram extends partially through the kiln wall to ensure that the fuel is entirely displaced into the kiln.

The support structure for the feeder includes a frame and set of rails which are arcuately shaped to be concentric with the outer periphery of the kiln. A counterbalance system urges against the feeder to minimize the force required to displace the feeder along the arcuate rails. With this embodiment, the kiln includes a radially projecting pin which engages the feeder and moves the feeder along the rails as the kiln rotates; when the pin rotates past the feeder support, the feeder is allowed to fall by the force of gravity back along the rails to a rest or docking position.

Also in a preferred embodiment, the kiln includes an inner ring which is positioned to be concentric with the kiln wall and includes opposing side walls and an outer surface. The inner ring is rotatably mounted within an outer, fixed ring, having an arcuate opening. The feeder preferably includes a ring segment which is slidably positioned within the fixed housing to close the arcuate opening. Consequently, the inner ring forms a seal with the outer, fixed ring, as does the ring segment, so that the connection between the feeder and kiln is sealed at all times.

Also in the preferred embodiment, the feeder assembly is incorporated into a larger system which includes a preprocessing device, such as an auger shredder. The auger shredder is connected to the feeder by a conduit which includes a pump to convey the preprocessed, shredded fuel along the conduit from the auger shredder to the feeder. The conduit is positioned to discharge preprocessed fuel into a hopper which is incorporated into the feeder when the feeder is at the docked or rest position.

Accordingly, it is an object of the present invention to provide a method and apparatus for injecting supplemental fuel into a rotary kiln which eliminates the need for containerizing or packaging the supplemental fuel; a method and apparatus which enables preprocessed, unpackaged fuel to be injected into the kiln for prolonged period, without interrupting the rotation of the kiln; a method and apparatus for injecting fuel into a rotary kiln in which the connection between the apparatus and the kiln minimizes the escape of heat and fumes; and a method and apparatus for injecting supplemental fuel which is adaptable to rotary kilns of any shape or length and which minimizes the amount of equipment which must be mounted on the rotary kiln itself.

Other advantages and objects of the present invention will be apparent from the following description, the accompanying drawings, and the appended claims.

DETAILED DESCRIPTION

Figure 1:
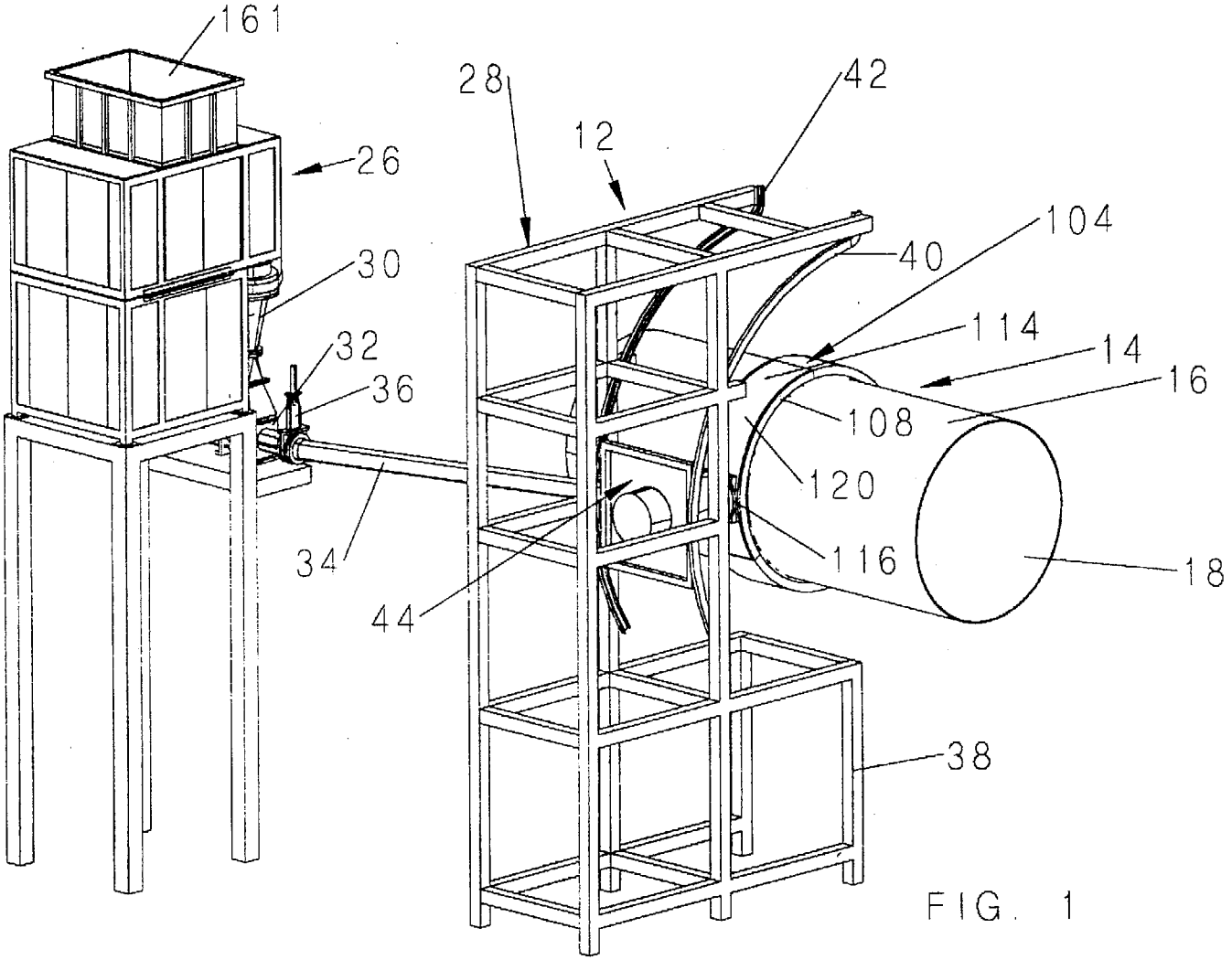
FIG. 1 is a schematic, perspective view of a system for providing supplemental fuel to a rotary cement kiln incorporating a preferred embodiment of the invention.
Figure 2:
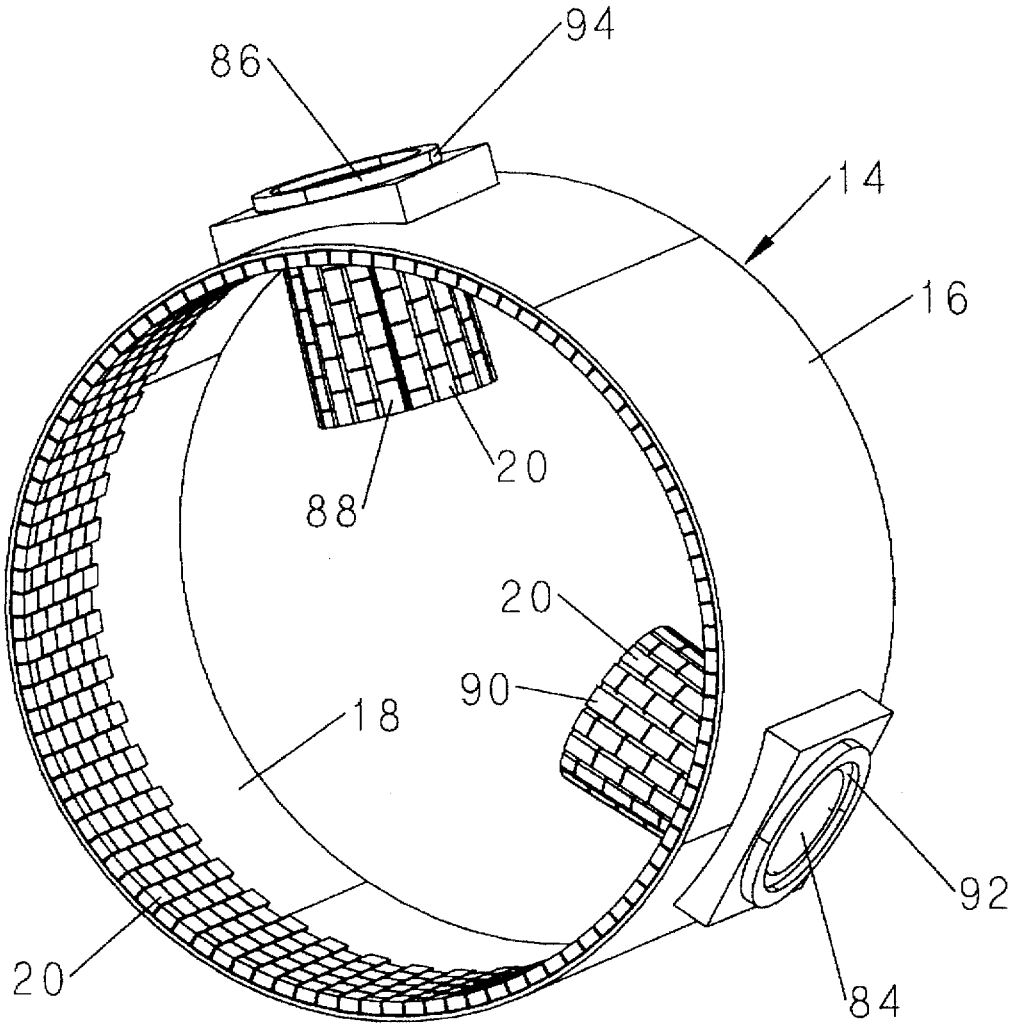
FIG. 2 is a schematic detail showing a cement kiln segment and feeding structure internal to the kiln.
Figure 5:
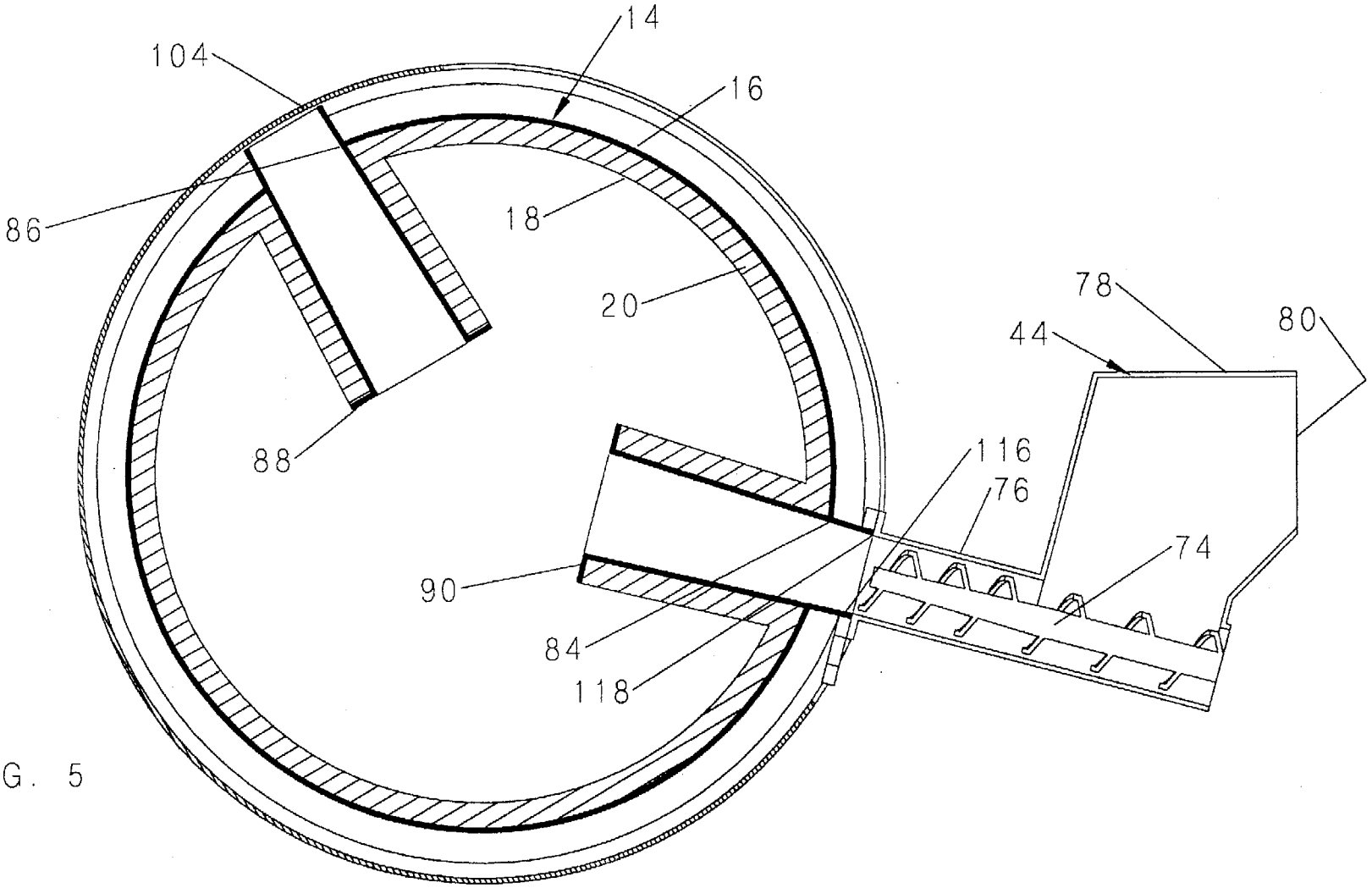
FIG. 5 is a schematic detail of the kiln end section and portion the feeding mechanism.

As shown in FIG. 1, the apparatus for providing supplemental fuel, generally designated 12, is designed to inject a supplemental fuel, such as municipal solid waste, ground or shredded tires, or hazardous waste, or the like, into a rotary cement kiln, generally designated 14. The cement kiln 14 includes a cylindrical body 16 having an interior surface 18 lined with firebrick 20 (see also FIG. 2). As shown in FIGS. 2 and 5, the wall 16 of the kiln 14 includes circular openings 84, 86, which allow material to be injected through the kiln wall into the interior of the kiln.

As shown in FIG. 1, the apparatus 12 includes a preprocessing component 26 and a feeding component 28. The preprocessing component 26 includes a tri-auger grinding, shredding and blending system, such as that shown in U.S. Pat. No. 5,217,173, the disclosure of which is incorporated herein by reference. The preprocessing component also includes a charging component 30 such as that shown in U.S. Pat. No. 5,481,851, the disclosure of which is incorporated herein by reference. The charging component 30 empties into a piston pump 32 which conveys the preprocessed, shredded supplemental fuel along a conduit 34 to the feeding station 28. A knife gate 36 is positioned at the head end of the conduit 34, and can be cycled to open or close the conduit as needed.

Figure 3:
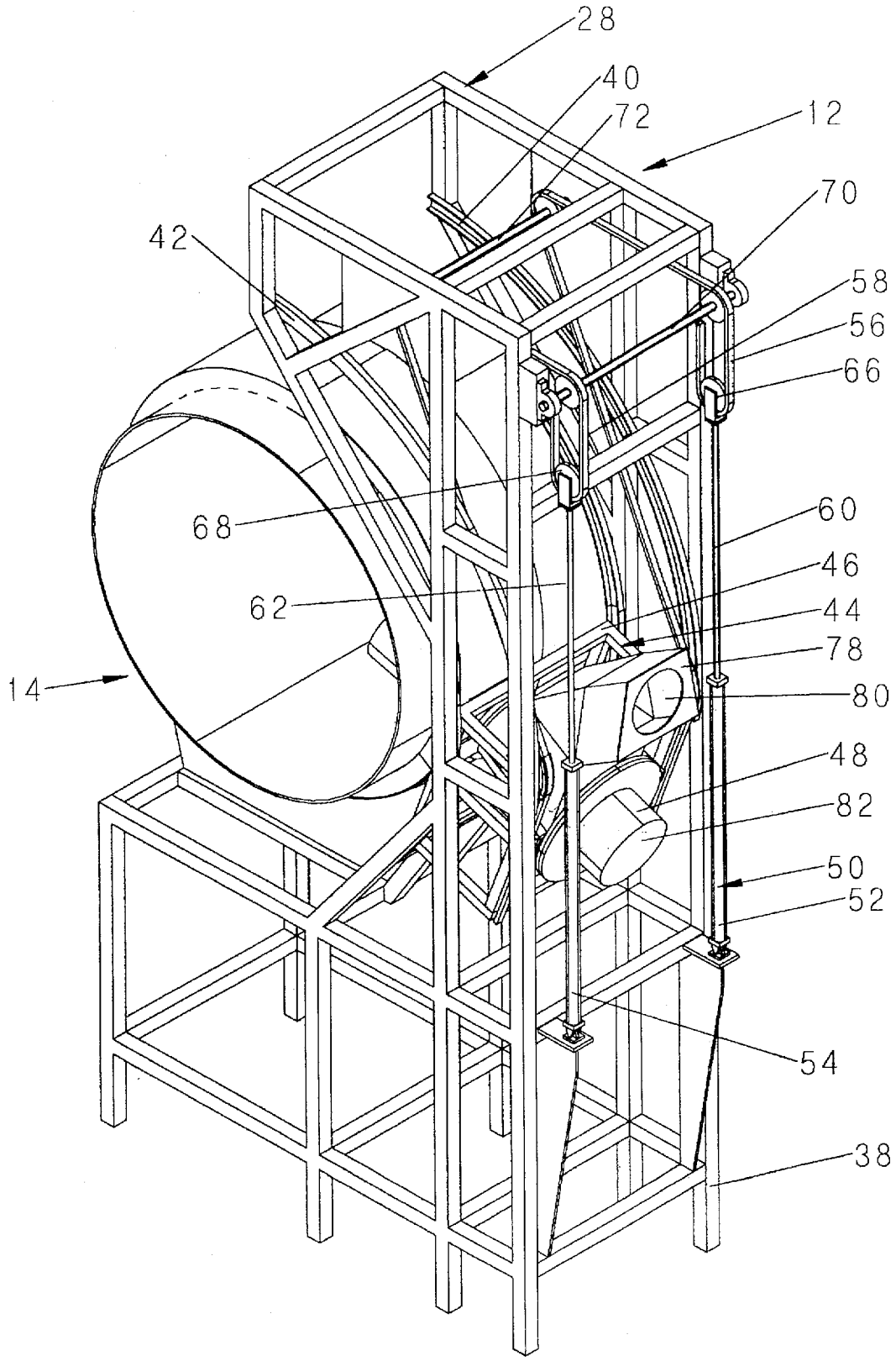
FIG. 3 is a schematic detail showing the feeding mechanism of FIG. 1.

As shown in FIG. 3, the feeding component 28 includes a support frame 38, which is positioned adjacent to the cement kiln 14, specifically at the calcining zone, and includes a pair of arcuately curved rails 40, 42. The feeding component 28 includes a feeder 44 which includes a carriage 46 which slidably engages the rails 40, 42 and supports a hydraulically driven screw 48. The carriage 46 is connected to a counterbalance system 50 which includes a pair of double acting cylinders 52, 54 which are connected to chains 56, 58 that, in turn, are connected to the carriage 46. When in operation, the cylinders 52, 54 are pressurized sufficiently to reduce the effective weight of the carriage 46 and screw 48 such that the effort required to move the carriage 46 along the rails 40, 42 is minimal, on the order of 500 pounds. The cylinder rods 60, 62 of the cylinders 52, 54 terminate in pulleys 66, 68 which engage the chains 56, 58. The chains 56, 58 extend over pulley set 70 and pulley set 72, then extend downwardly to the carriage 46.

As shown in FIGS. 3 and 5, the screw 48 includes a threaded shaft 74 contained within a housing 76 which communicates with a hopper 78. The hopper has an opening 80 which is shaped to receive fuel from the conduit 34 (see FIG. 1). The screw 48 is driven by a hydraulic motor 82 which is also contained within the housing 76.

Figure 6:
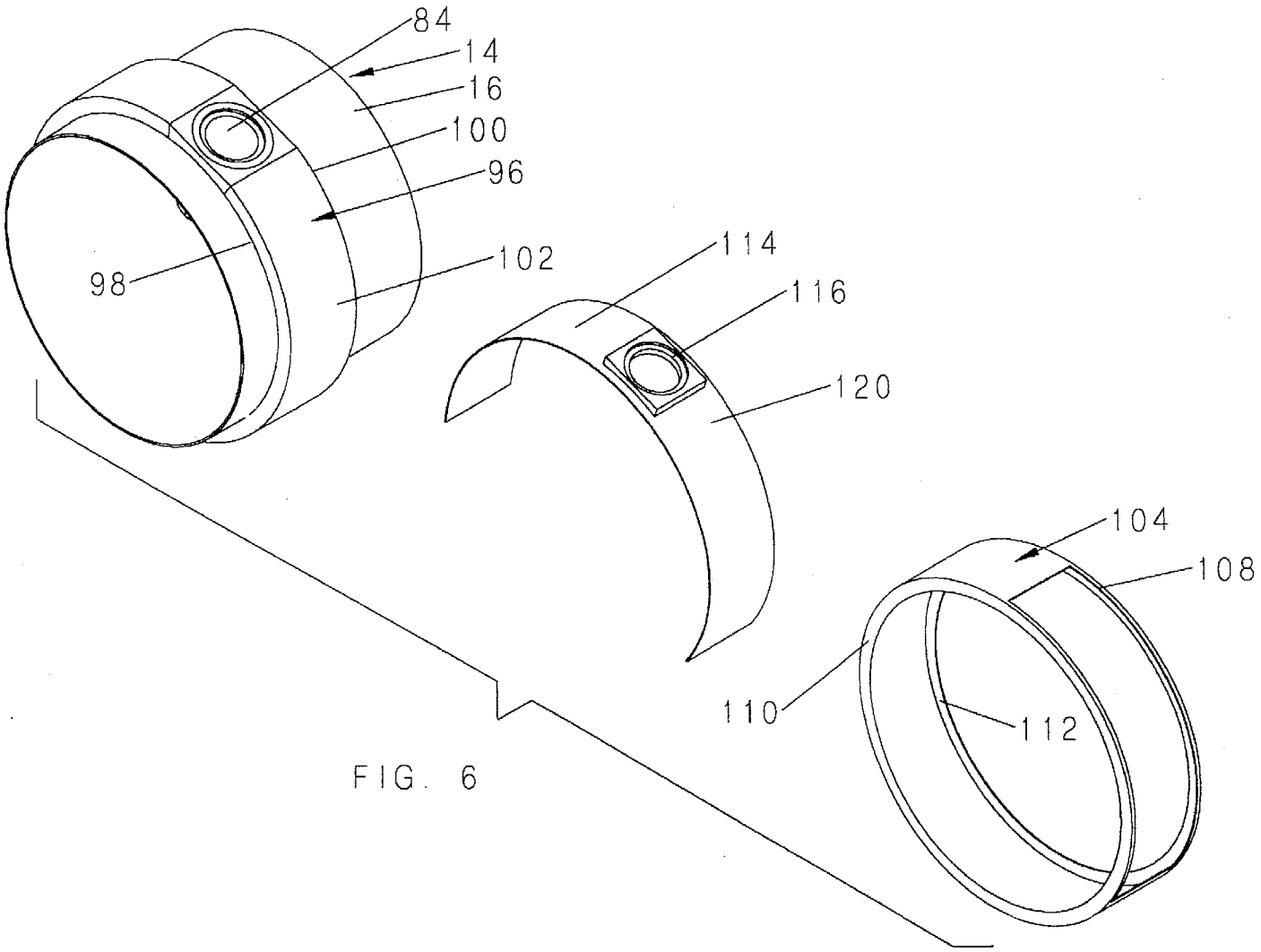
FIG. 6 is an exploded, perspective view of the ring structure of the feeder mechanism.

As shown in FIGS. 2 and 5, the kiln 14 includes openings 84, 86 into the interior of the kiln, which communicate with conduits 88, 90 lined with firebrick 20. The openings 84, 86 also communicate with flanges 92, 94 which are incorporated into a ring 96 mounted on the kiln wall 16, as shown in FIG. 6. The ring 96 includes raised sidewalls 98, 100 and an outer wall 102.

Figure 4:
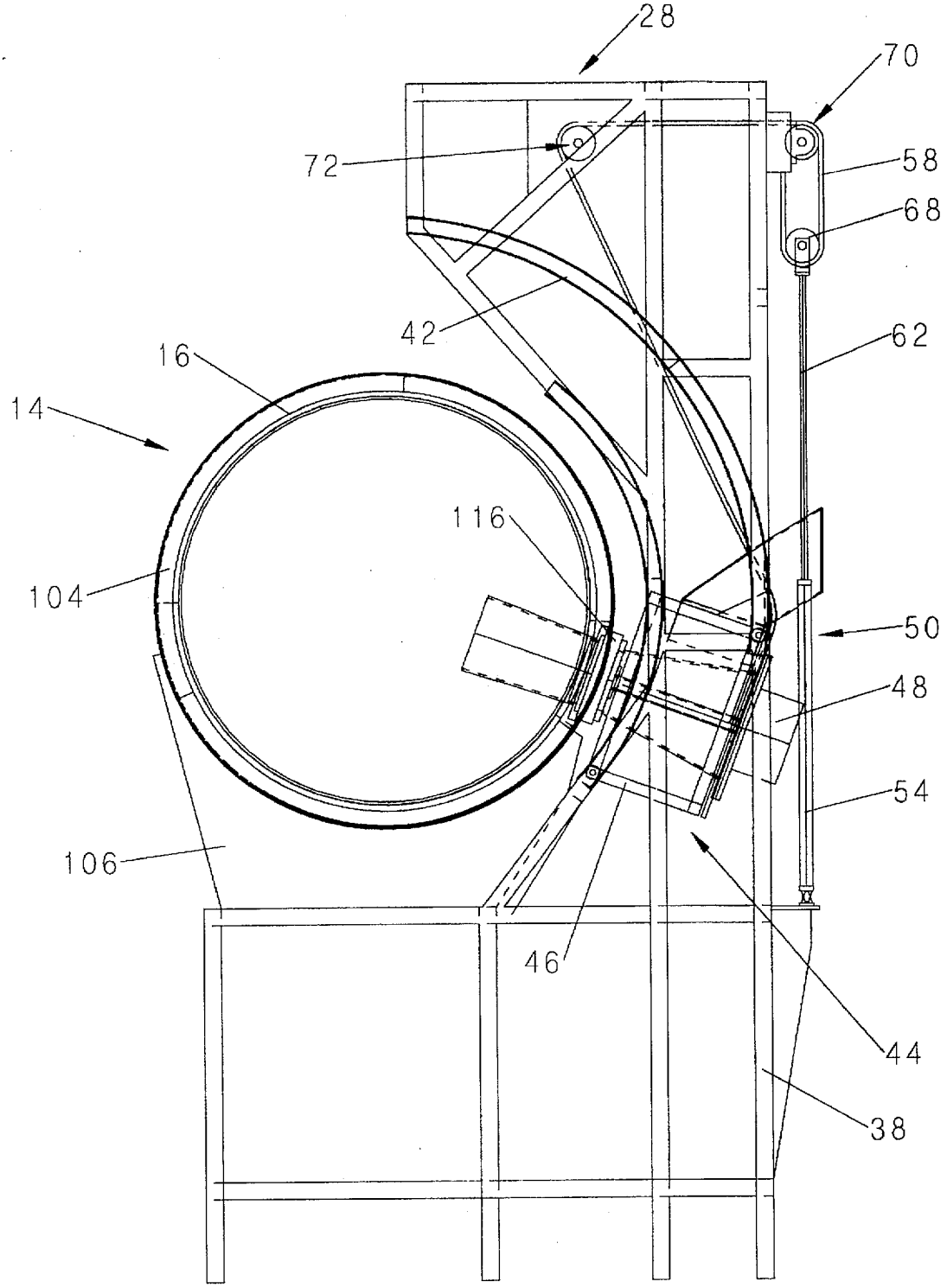
FIG. 4 is a schematic side elevation of the feeding mechanism of FIG. 3.

A fixed ring 104 is mounted on a bracket 106 (see FIG. 4) which, in turn, is supported on the support frame 38. The fixed ring 104 includes an arcuate slot 108. The fixed ring 104 is superposed to and is concentric with the ring 96, so that rotation of the kiln 14 brings the openings 84, 86, and flanges 92, 94 across the arcuate slot 108. The ends 110, 112 of the fixed ring are shaped to make a seal with the corresponding sidewalls 98, 100 of the ring 96.

As shown in FIGS. 1 and 6, the feeder 44 includes an arcuate ring 114 which is shaped and positioned to fit within the ring 104, and includes an opening 116 which is connected to the end 118 (FIG. 5) of the housing 76 of the feeder 44. The arcuate ring includes an arcuate wall 120 which slides within the fixed ring 104, so that wall 120 covers the arcuate slot 108, as shown in FIG. 1.

Figure 7:
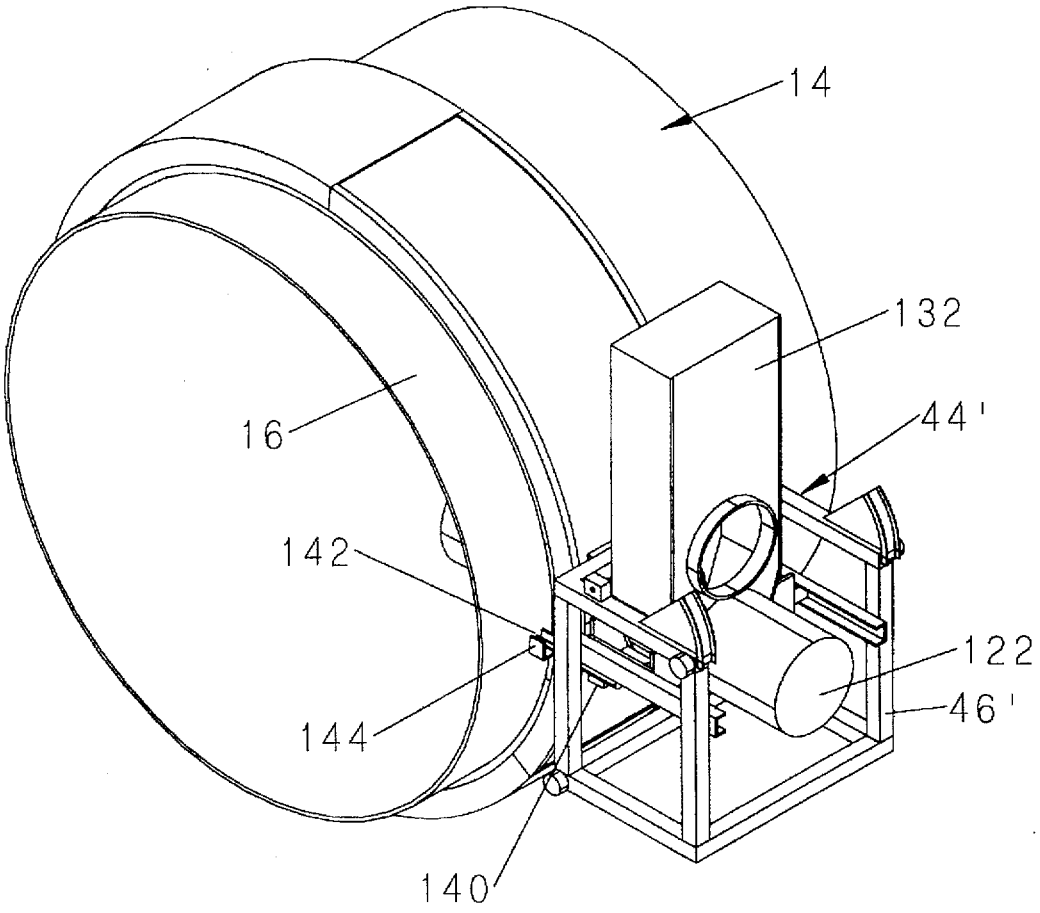
FIG. 7 is a detail perspective view of an alternate embodiment of the invention.
Figure 8:
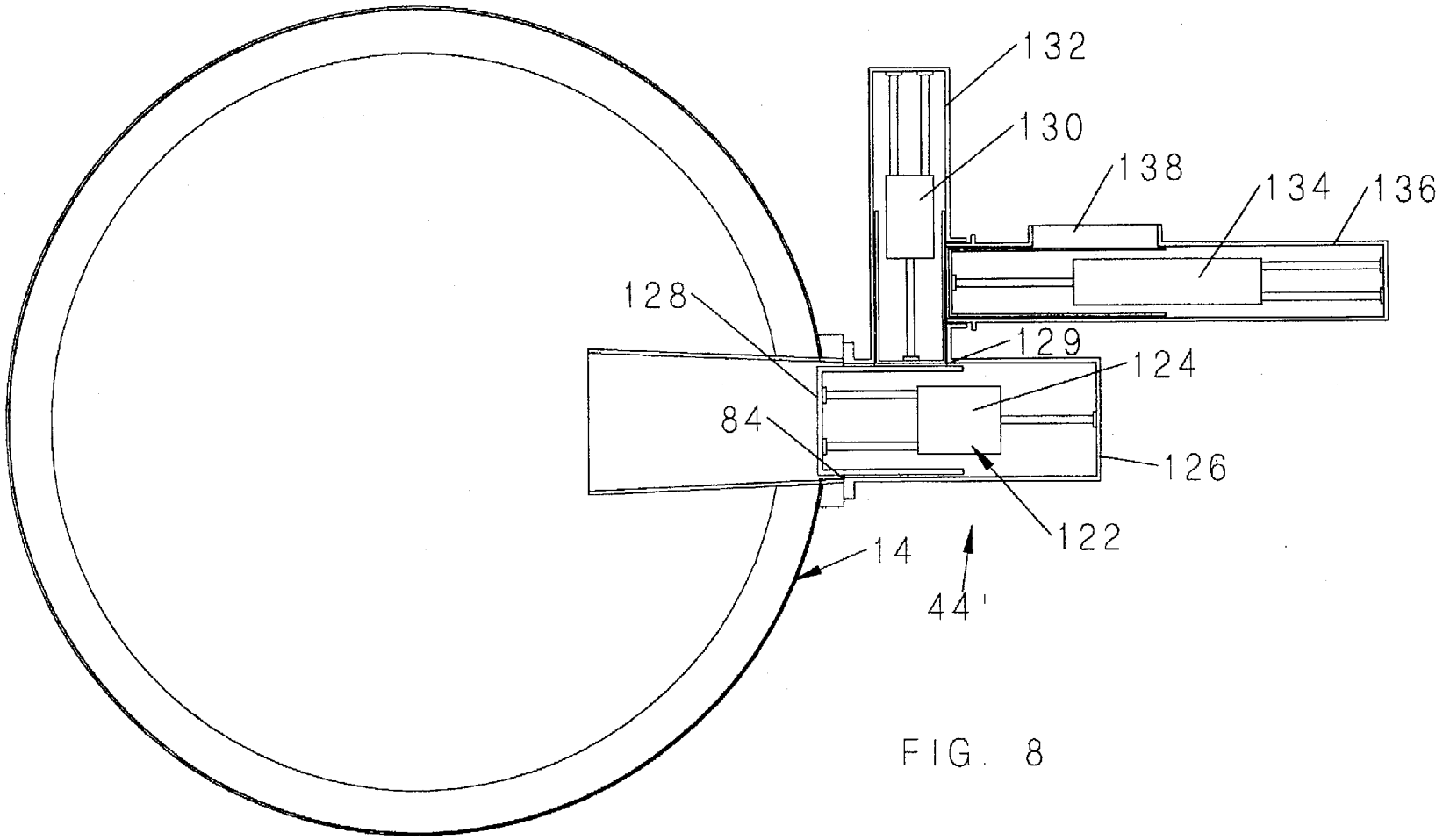
FIGS. 8 and 9 are schematic, side elevations of the feeding mechanism of the embodiment of FIG. 7.
Figure 9:
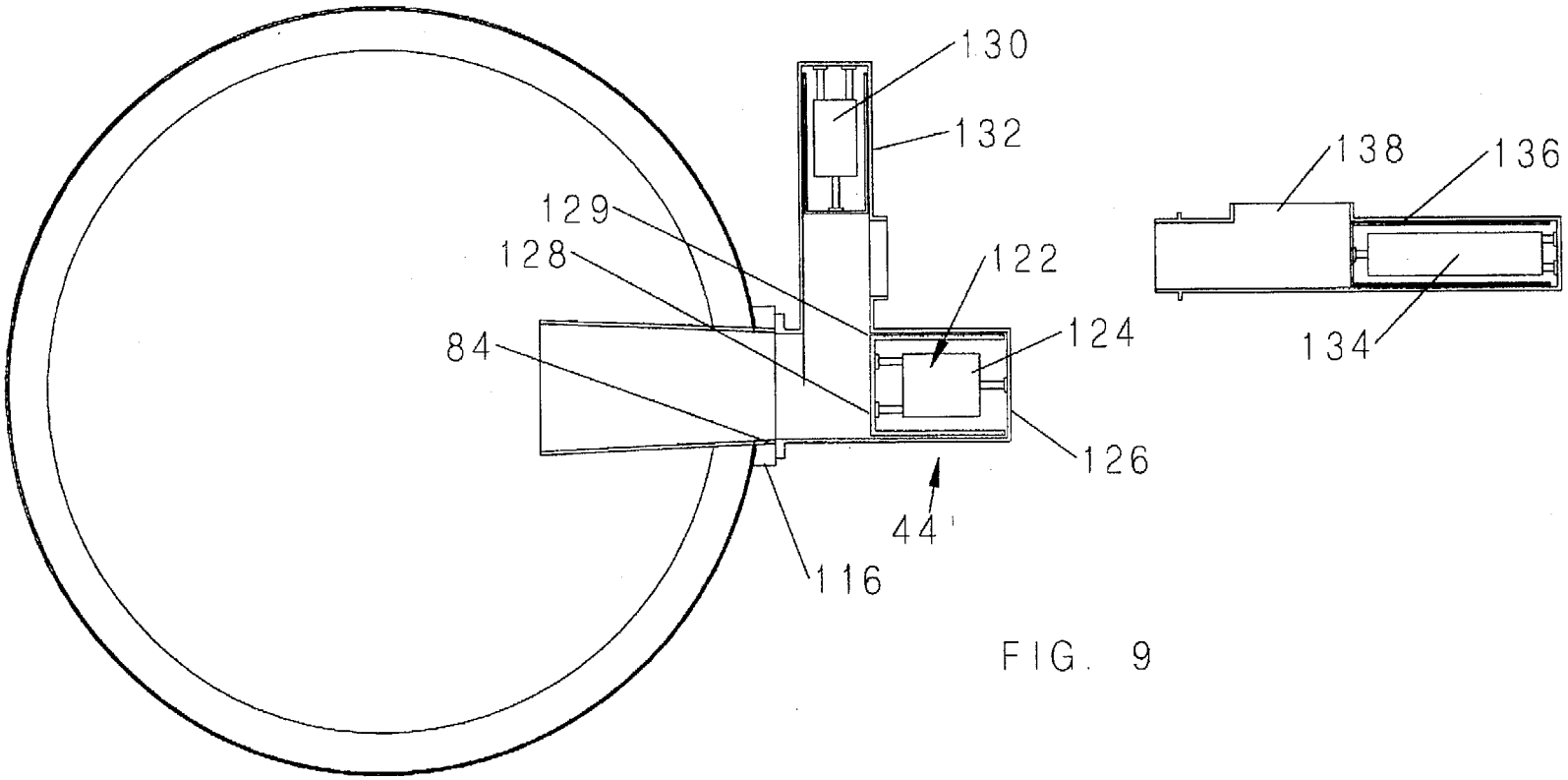

As shown in FIGS. 7, 8 and 9, an alternate embodiment of the feeder 44' includes a ram feeding element 122. The ram 122 includes a pocket cylinder 124 of the type disclosed in U.S. Pat. No. 5,353,687, the disclosure of which is incorporated herein by reference, mounted within a cylindrical housing 126, and including a head 128. The housing 126 includes an opening 129 which is connected to a secondary ram 130 mounted within a housing 132. That ram 130, in turn, is fed by a third ram 134 within housing 136. Housing 136 includes an opening 138 which communicates with feeding conduit 34. Accordingly, preprocessed fuel is conveyed by conduit through opening 138, where it is displaced by ram 134 into housing 132, and from there, it is displaced by ram 130 into housing 126, where ram 124 displaces the fuel into the kiln 14 through an opening 84.

As shown in FIG. 7, the carriage 46' includes a cylinder 140 which actuates a pin 142. The pin 142 is positioned to be engaged by a bracket 144 which is mounted on the exterior surface of the kiln 14. Consequently, rotation of the kiln 14 brings the bracket 144 into contact with the pin 142, and the continued rotation kiln 14 raises the carriage 46' and consequently the ram system 122, along the rails 40, 42 (see FIG. 1).

Although not shown, the carriage 46 of the embodiment of FIG. 1 also includes the pin and bracket structure which accomplishes the displacement function. With the embodiment of FIGS. 7–9, the frame 38, rails 40, 42 and feeding conduit 34 are the same as that shown in FIG. 1. As shown in FIG. 9, the housing 136 preferably is retractable from the housing 132 of the feeder 44' so that the feeder 44' can be displaced along the rails 40, 42 (see FIG. 1).

Figure 10:
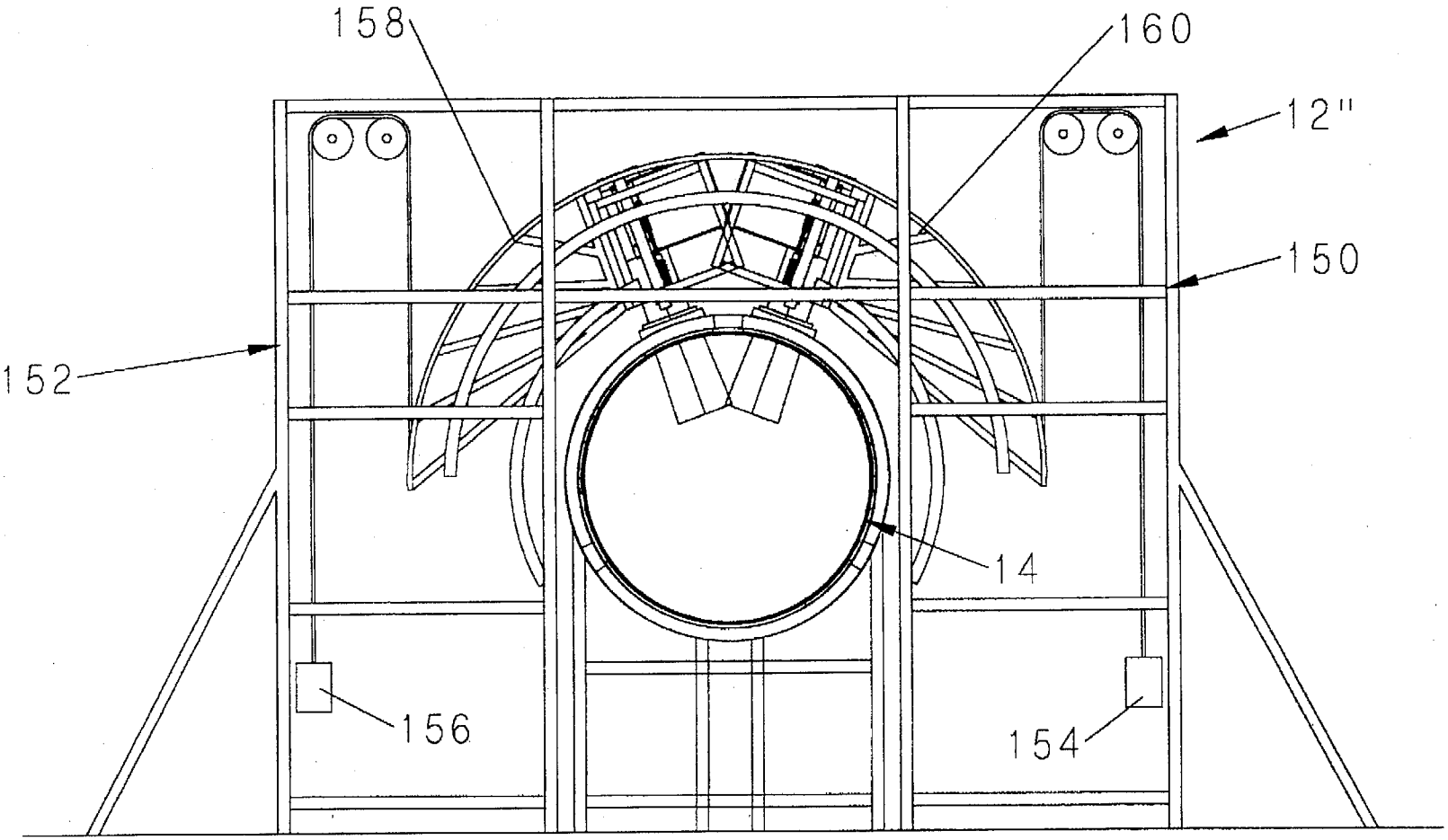
FIG. 10 is a schematic end elevation of a second alternate embodiment of the present invention.

As shown in FIG. 10, a second alternate embodiment 12" of the invention includes twin feeding systems 150, 152 each of which is constructed similarly to that shown in FIG. 1. In addition, a variation of the counterbalance is shown, which weights 154, 156 are employed to displace the carriages 158, 160 to correspond with the rotation of the kiln 14.

The operation of the apparatus is as follows. Supplemental fuel is deposited into hopper 161 of the preprocessing component (see FIG. 1) where it is ground and shredded by a series of auger screws and injected by injector 30 into the pump 32. Pump 32 conveys the shredded and blended fuel along conduit 34 to the hopper 78 where it enters into opening 80 (see FIG. 5) and is collected within the housing. As the kiln rotates, an opening 84, for example, comes into alignment with the housing 76 of the feeder 44. At that time, the bracket 144 engages the pin 142 and continued rotation of the kiln causes the carriage 46 to travel along rails 40, 42. At this time, the hydraulic motor 82 is actuated to rotate screw 48 and inject the fuel through the opening 84 along conduit 90. At the end of the injection step, the cylinder 140 is actuated to retract the pin 142, which disengages with bracket 144, and in turn, allows the carriage 46 to fall back along the rails 40, 42 under the weight of gravity to the docking or rest position shown in FIG. 1.

In the alternate embodiment, preprocessed, shredded and blended waste fuel is conveyed to housing 136 where the cylinder 134 displaces the fuel to housing 132. From there, a cylinder 130 is actuated to displace the fuel into housing 126, where cylinder 124 displaces the fuel into the kiln 14, the displacement by cylinder 124, and, if necessary by cylinder 130, is accomplished as the carriage 46' is displaced along rails 40, 42.

In conclusion, the structure of the invention allows pre-processed blended fuel to be injected into a cement kiln through the kiln wall into the calcining zone, by providing a synchronous movement of the feeding mechanism with the cement kiln, so that the feeding mechanism remains in alignment with the feeding port for a maximum period of time. The connection between the cement kiln and the feeder is sealed by way of the ring system shown in FIG. 6.

While the forms of apparatus herein described constitute a preferred embodiments of this invention, it is understood that the invention is not limited to these precise forms of apparatus, and that modifications may be made without departing from the scope of the invention.

What is claimed is:

1. An apparatus for providing supplemental fuel to a rotary kiln comprising:

a feeder for receiving supplemental fuel from a fuel source and for injecting said supplemental fuel into an interior of said kiln; and a feeder support for moving said feeder synchronously with said kiln only during a portion of rotation of said kiln less than a complete rotation thereof so that said feeder remains in alignment with an opening in said kiln a period of time sufficient to allow said feeder to inject said fuel through said opening.

2. An apparatus for providing supplemental fuel to a rotary kiln comprising:

a feeder for receiving supplemental fuel and injecting said supplemental fuel into an interior of said kiln; and a feeder support for moving said feeder synchronously with rotation of said kiln so that said feeder remains in alignment with an opening in said kiln a period of time sufficient to allow said feeder to inject said fuel through said opening;

said support including a carriage mounting said feeder, and rails for supporting said carriage on an arcuate path corresponding to a curve of an outer periphery of said kiln.

3. The apparatus of claim 2 wherein said support includes a coupling mounted on said kiln positioned to releasably engage said feeder such that rotation of said kiln brings said coupling into contact with said feeder so that said feeder is in alignment with an opening in said kiln and moves along said rails synchronously with said kiln rotation.

4. The apparatus of claim 3 wherein said support further includes a counterbalance connected to said carriage such that a force applied by said coupling to said feeder necessary to displace said carriage along said rails is reduced.

5. The apparatus of claim 4 wherein said counterbalance incudes a double-acting cylinder; and a chain connected to said cylinder and said carriage; whereby pressurization of said cylinder causes said chain to pull against said carriage in an upward direction.

6. The apparatus of claim 1 wherein said feeder includes a screw feeder for injecting said fuel into said kiln.

7. The apparatus of claim 1 wherein said feeder includes first ram for injecting said fuel into said kiln.

8. The apparatus of claim 7 wherein said feeder includes a second ram for receiving said fuel and displacing said fuel adjacent to said first ram.

9. The apparatus of claim 8 wherein said first ram has a length of travel sufficient to enter an opening in said kiln.

10. The apparatus of claim 9 further comprising an interior conduit positioned within said kiln for receiving said fuel from said feeder and directing said fuel into an interior of said kiln.

11. The apparatus of claim 1 wherein said feeder includes a housing having an external conduit, communicating with an interior of said kiln, for conveying said fuel to said kiln.

12. The apparatus of claim 1, wherein said feeder support includes a coupling for interconnecting said feeder to said kiln so that said feeder remains in alignment with said opening in said kiln for a period of time sufficient to allow said feeder to inject said fuel through said opening, and for releasing said feeder from said kiln for a period of time sufficient to allow said feeder to receive additional supplemental fuel from said fuel source.

13. An apparatus for providing supplemental fuel to a rotary kiln comprising:

a feeder for receiving supplemental fuel and injecting said supplemental fuel into an interior of said kiln;

a feeder support for moving said feeder synchronously with rotation of said kiln so that said feeder remains in alignment with an opening in said kiln a period of time sufficient to allow said feeder to inject said fuel through said opening;

a fixed annular housing enclosing said kiln at a midportion thereof, said fixed housing having an arcuate opening therethrough; and a ring segment, connected to said feeder and slidably positioned within said fixed housing, shaped to close said arcuate opening substantially completely during said synchronous movement of said feeder.

14. The apparatus of claim 13 further comprising an inner annular ring positioned within said fixed ring and attached to said kiln to rotate therewith, said fixed ring having raised sidewalls shaped to form a seal with said fixed housing.

15. The apparatus of claim 14 wherein said inner annular ring includes an outer wall shaped to bear against and support said ring segment.

16. The apparatus of claim 15 wherein said inner annular ring includes an opening communicating with an interior of said kiln.

17. A system for pre-processing and providing supplemental fuel to a rotary kiln comprising:

a reducing device for receiving and pre-processing supplemental fuel by reducing the size of said supplemental fuel;

a feeder, connected to said reducing device, for receiving said pre-processed fuel from said reducing device and injecting said pre-processed fuel into an interior of said kiln; and a feeder support for moving said feeder synchronously with said kiln only during a portion of rotation of said kiln less than a complete rotation thereof so that said feeder remains in alignment with an opening in said kiln for a period of time sufficient to allow said feeder to inject said fuel through said opening.

18. The system of claim 17 further comprising a conveyor connected to said reducing device and said feeder for transporting said pre-processed fuel reduced in size by said reducing device to said feeder.

19. The system of claim 17 wherein said reducing device is an auger shredder.

20. The system of claim 17 wherein said reducing device includes a reciprocating pump to convey fuel along said conveyor.

21. A method for feeding supplemental fuel to a rotary kiln at a midportion thereof comprising the steps of:

pre-processing said supplemental fuel by reducing the size of said fuel;

conveying said pre-processed fuel in a closed conveyor to a kiln feeder;

coupling said kiln feeder to said kiln for a first portion of a rotation of said kiln, said first portion being less than a complete rotation of said kiln, such that said feeder is aligned with an opening in said kiln during said first portion of the rotation thereof;

injecting said pre-processed fuel into said kiln during said feeder coupling step; and releasing said kiln feeder from said kiln for a remaining portion of the rotation of said kiln.

22. The method of claim 21 wherein said injecting step includes the step of actuating a ram to displace said fuel into said kiln.

23. The method of claim 21 wherein said injecting step includes the step of actuating a screw conveyor in said kiln feeder.

24. A method for feeding supplemental fuel to a rotary kiln at a midportion thereof comprising the steps of:

pre-processing said supplemental fuel by reducing the size of said fuel;

conveying said pre-processed fuel in a closed conveyor to a kiln feeder;

moving said kiln feeder synchronously with rotation of said kiln such that said feeder is aligned with an opening in said kiln during a portion of the rotation thereof: and injecting said pre-processed fuel into said kiln during said feeder movement step;

said moving step includes a step of counterbalancing said kiln feeder so that a minimal force is required for moving said kiln feeder synchronously with said kiln.

25. A method for feeding supplemental fuel to a rotary kiln at a midportion thereof comprising the steps of:

pre-processing said supplemental fuel by reducing the size of said fuel;

conveying said pre-processed fuel in a closed conveyor to a kiln feeder;

moving said kiln feeder synchronously with rotation of said kiln such that said feeder is aligned with an opening in said kiln during a portion of the rotation thereof: and injecting said pre-processed fuel into said kiln during said feeder movement step;

said moving step includes a step of interconnecting said feeder and said kiln for only a portion of a rotation of said kiln such that rotation of said kiln causes said feeder to move synchronously with said kiln in alignment with said opening of said kiln.

26. An apparatus for providing supplemental fuel to a rotary kiln comprising:

a feeder for receiving supplemental fuel and injecting said supplemental fuel into an interior of said kiln; and a feeder support for moving said feeder synchronously with rotation of said kiln so that said feeder remains in alignment with an opening in said kiln a period of time sufficient to allow said feeder to inject said fuel through said opening;

said support including a coupling mounted on said kiln positioned to releasably engage said feeder such that rotation of said kiln brings said coupling into contact with said feeder so that said feeder is in alignment with an opening in said kiln and moves synchronously with said kiln rotation;

said coupling being further adapted to release said feeder such that said feeder moves synchronously with said kiln rotation for a period of rotation less than a complete rotation thereof.

27. An apparatus for providing supplemental fuel to a rotary kiln comprising:

a source of supplemental fuel stationarily positioned with respect to a rotary kiln;

a feeder for receiving supplemental fuel from said source and for injecting said supplemental fuel into an interior of said kiln; and a feeder support configured align said feeder with an opening in a circumferential side said kiln, during a portion of kiln rotation less than a complete rotation thereof, so as to allow said feeder to inject supplemental fuel into said interior of said kiln during said portion of kiln rotation, said feeder support being further configured to reciprocate said feeder back into alignment with said source after said portion of kiln rotation, so as to allow said feeder to receive additional supplemental fuel from said source.

* * * * *

UNITED STATES PATENT AND TRADEMARK OFFICE

CERTIFICATE OF CORRECTION

PATENT NO. : 5,724,896

DATED : March 10, 1998

INVENTOR(S) : Larry E. Koenig

It is certified that error appears in the above-indentified patent and that said Letters Patent is hereby corrected as shown below:

Claim 7, Col. 6, Line 14, word --a-- is missing after "includes".

Claim 20, Col. 7, Line 17, "Claim 17" should be --Claim 18--.

Signed and Sealed this

Nineteenth Day of May, 1998

Bruce Lehman

*Attest:*

BRUCE LEHMAN

*Attesting Officer*

*Commissioner of Patents and Trademarks*